US005431230A

United States Patent [19]

Land et al.

[11] Patent Number: 5,431,230

[45] Date of Patent: Jul. 11, 1995

[54] SLANT WELLBORE TUBING ANCHOR CATCHER WITH ROTATING MANDREL

[75] Inventors: John L. Land, Hobbs, N. Mex.; Rodger D. Lacy, Casper, Wyo.

[73] Assignee: Rotating Production Systems, Inc., N. Mex.

[21] Appl. No.: 313,660

[22] Filed: Sep. 27, 1994

Related U.S. Application Data

[63] Continuation of Ser. No. 47,458, Apr. 19, 1993, abandoned, which is a continuation-in-part of Ser. No. 889,569, May 28, 1992, Pat. No. 5,327,975, which is a continuation-in-part of Ser. No. 682,499, Apr. 8, 1991, Pat. No. 5,139,090.

[51] Int. Cl.[6] ..... E21B 17/046; E21B 17/05; E21B 43/00

[52] U.S. Cl. ..... 166/369; 166/50; 166/68; 166/73; 166/78; 166/117.7

[58] Field of Search ..... 166/68, 68.5, 50, 69, 166/73, 78, 117.7, 210, 240, 242, 369, 378, 379, 381, 380, 382, 216

[56] References Cited

U.S. PATENT DOCUMENTS

| | | | |
|---|---|---|---|
| 1,560,984 | 11/1925 | Gorbutt . | |
| 1,650,102 | 11/1927 | Tschappat . | |
| 1,965,907 | 7/1934 | Pierce . | |
| 2,178,700 | 11/1939 | Penick et al. . | |
| 2,294,061 | 8/1942 | Williamson | 166/78 |
| 2,471,198 | 5/1949 | Cormany | 166/78 |
| 2,595,434 | 5/1952 | Williams | 166/78 |
| 2,599,039 | 6/1952 | Baker . | |
| 2,630,181 | 3/1953 | Solum . | |
| 2,660,248 | 11/1953 | Brown . | |
| 2,678,696 | 5/1954 | Crake . | |
| 2,693,238 | 11/1954 | Baker | 166/78 |
| 2,695,670 | 11/1954 | Crake . | |
| 2,788,074 | 4/1957 | Brown | 166/78 |
| 2,869,469 | 1/1959 | Williams . | |
| 2,876,844 | 3/1959 | Warner | 166/208 |
| 3,075,584 | 1/1963 | Brown | 166/210 X |
| 3,100,538 | 8/1963 | Sanders | 166/117.7 |
| 3,104,708 | 9/1963 | Orr et al. . | |
| 3,171,491 | 3/1965 | States | 166/208 |
| 3,191,683 | 6/1965 | Alexander . | |
| 3,643,737 | 2/1972 | Current et al. | 166/139 X |
| 4,010,804 | 3/1977 | Garcia | 166/208 X |
| 4,176,715 | 12/1979 | Bigelow et al. | 166/138 |
| 4,278,278 | 7/1981 | Chambless et al. | 166/240 X |
| 4,565,245 | 1/1986 | Mims et al. | 166/50 |
| 4,601,343 | 7/1986 | Lindsey, Jr. et al. | 166/242 X |
| 4,688,642 | 8/1987 | Baker | 166/382 |
| 4,787,457 | 11/1988 | Webster et al. | 166/286 |
| 4,926,938 | 5/1990 | Lindsey, Jr. | 166/208 |
| 5,139,090 | 8/1992 | Land | 166/369 |

OTHER PUBLICATIONS

Page from "Lufkin Slant Hole Units" advertising brochure, Lufkin Industries, Inc.

*Primary Examiner*—Hoang C. Dang
*Attorney, Agent, or Firm*—Marcus L. Bates

[57] ABSTRACT

A crooked, slanted, cased wellbore extends downhole to a pay zone which is produced by a rod actuated downhole pump that lifts fluid from the bottom of the wellbore up through a tubing string to a wellhead. The pump is seated in a pump cavity, and the tubing string is tensioned at opposed ends while it is rotated. The upper end of the tubing string is attached to a fluid conveying swivel and a tubing rotator. A tubing anchor having a fluid conveying rotatable mandrel is attached adjacent to and forms part of the lower end of the tubing string by which the lower end of the tubing string is rotatably tensioned and releasably affixed to the casing in proximity to the lower end of the wellbore. A plurality of radially active slips are actuated in response to manipulation of the tubing string to extend the slips into engagement with the casing wall and to retract the slips in order to remove the tubing string from the borehole.

14 Claims, 3 Drawing Sheets

SLANT WELLBORE TUBING ANCHOR CATCHER WITH ROTATING MANDREL

RELATED PATENT APPLICATIONS

This patent application is a Continuation of patent application Ser. No. 08/047,458 filed Apr. 19, 1993, now abandoned, which in turn is a Continuation-In-Part of patent application Ser. No. 07/889,569 filed May 28,1992, now U.S. Pat. No. 5,327,975, issued Jul. 12, 1994, which in turn is a Continuation-In-Part of patent application Ser. No. 07/682,499 filed Apr. 8, 1991, now U.S. Pat. No. 5,139,090 issued Aug. 18, 1992.

BACKGROUND OF THE INVENTION

In our patent application Ser. No. 07/889,569 filed May 28, 1992, now U.S. Pat. No. 5,327,975, it is pointed out that rotating the production tubing string respective to the sucker rod and casing string while concurrently placing the production tubing string in tension reduces the severity of wear of a curved tubing string by reducing the contact area between the tubing string and rod string. This redistribution of wear between the sucker rod string and the tubing string is very desirable for it reduces the maintenance cost of the well, and additionally reduces the cyclic working (tension changes) of the production string and thereby overcomes many problems associated with crooked wellbores. Moreover, such an arrangement provides the unexpected benefit of enhancing the protection of the sucker rod and production tubing afforded by corrosion inhibitors which is realized because the rod and tubing rubbing surfaces are continually moved away from the contact area therebetween, thereby progressively treating the entire surface of the rod and tubing string each rotation of the tubing string.

The present invention comprehends the use of the apparatus of our prior patent in a slanted borehole. The present invention sets forth an improved new tubing rotator used in conjunction with the anchor device of our prior patent, by which the production tubing string is placed in tension while being rotated from the surface, to enable a slanted borehole to be produced in accordance with the method and apparatus set forth herein.

In this patent application, the term "slanted borehole" means a wellhead axially aligned with a casing string extending at an acute angle respective to the vertical and particularly at about 7–45 degrees respective to the vertical.

The term "crooked borehole" means a drilled hole such as a wellbore formed in the ground having a longitudinal central axis that meanders away from a straight line such that the central axis exhibits a sinusoidal wave form having an amplitude that causes a rod string located within a tubing string thereof to rub against one another at several spaced apart locations.

The term "tensioned" means that the upper and lower mandrels of the rotator and anchor are forced diametrically apart to load the upper marginal terminal end of the tubing string a tension magnitude that significantly exceeds the tension produced by the static weight of the tubing string such that the lowermost marginal terminal end of the tubing string is held in a substantial magnitude of tension.

The term "anchor" means a downhole tubing anchor device or a tubing catcher device having a mechanical apparatus thereon that is selectively actuated to prevent axial movement respective to the casing string, and is improved by the addition of a rotatable mandrel connected to form part of the tubing string flow path while rotatably holding the lower end of the tubing string in tension. There may be another length of tubing string extending downhole of the mandrel.

The term "wellbore" means a hole drilled into the ground such as a borehole or a well.

The term "cased hole" or casing means a casing string or other means associated with at least the upper end of a borehole by which the tubing rotator can be supported from close proximity of the surface.

The term "rod" means a polish rod, a rod string, a sucker rod string, a rotating shaft, as well as any rotatable or reciprocatory member extending down through a tubing string for actuating a downhole pump means for producing a well.

SUMMARY OF THE INVENTION

A cased, slanted, crooked wellbore extends downhole from a wellhead to a pay zone. The well is produced by a shaft actuated downhole pump that lifts fluid from the bottom of the wellbore up through a tubing string to a wellhead. A tubing rotator has a mandrel that forms a tubing hanger. The tubing hanger is rotatably mounted in attached relationship adjacent the upper end of the production tubing string. The mandrel rotatably supports the tubing string from the wellhead while placing the upper end of the tubing string in tension. A fluid conveying-swivel means is attached near the rotator to allow produced fluid to be discharged from the upper end of the tubing string.

A combination tubing anchor catcher with fluid conveying rotatable mandrel is attached to and forms part of the tubing string. The tubing anchor affixes the mandrel and hence the tubing string to the casing interior at a location downhole in the wellbore, thereby holding a lower end of the rotating tubing string in tension.

One embodiment of the invention discloses a tubing anchor having a rotatable mandrel extending longitudinally therethrough and forming a part of the lower end of the tubing string; and, further includes a journal means by which the mandrel rotates respective to the anchor device to provide the means by which the lower end of the tubing string is rotatably held tensioned respective to the tubing anchor, sucker rod string, and casing string while conveying fluid from a downhole pump, up through the rotating tensioned production tubing string, and to a swivel at the top of the wellhead.

More specifically, the anchor device has an outer barrel concentrically arranged within the casing and extending about the rotatable mandrel, and the rotating mandrel is hollow and extends about the sucker rod string. A locking device selectively locks and unlocks the mandrel respective to the barrel so that retraction and extension of the tubing anchor slips is achieved upon manipulation of the tubing string, which results in the tubing anchor slips being anchored and released respective to the casing wall. The tubing anchor mandrel forms an axial passageway through which the sucker rod string extends and through which produced fluid flows from the production pump located therebelow. The tubing string is placed in tension between a rotator (at the well head) and the downhole anchor device, and the tensioned tubing string rotated respective to the rod string and casing.

A primary object of the present invention is the provision of production apparatus and method for producing a slanted borehole having a wellhead arranged at an angle respective to the horizontal. The production apparatus includes a tubing anchor device having a fluid conveying rotatable mandrel and further includes slips by which the lower end of a tubing string is rotatably and releasably affixed to the casing in proximity to the lower end of a wellbore. An upper mandrel is affixed to the upper end of the tubing string and is rotated by a tubing rotator of this invention.

Another object of the invention is to provide and disclose apparatus by which a tubing string is rotated while in tension and includes a tubing rotator apparatus by which the tubing string is supported from the wellhead. The apparatus includes a downhole tubing anchor device for a rod actuated downhole pump of the rotary or reciprocatory type, wherein the anchor device includes a journaled mandrel and slips by which a fluid conveying tensioned tubing string can rotate respective to the anchor slips, rod string, and well casing.

A still further object of this invention is to provide a tensioned rotating production string having a tubing rotator at the upper end thereof and a downhole tubing anchor device at the other end thereof associated with a slanted wellbore. The slanted tubing string is placed under tension and rotated respective to the anchor device. Means are provided by which the tubing string moves the mandrel between alternate positions of operation to anchor and to release the anchor device respective to the casing wall.

Another and still further object of this invention is the provision of method and apparatus for reducing wear between a rod string and a tubing string used in producing a crooked, slanted borehole by connecting the tubing string to a rotating mandrel of an anchor device and rotating the tubing string respective to the rod and casing string thereof while concurrently placing the tubing string in tension and thereby reducing the severity of wear of the curved string by reducing the contact area between the tubing and rod string and concurrently distributing the wear between the rod string and the tubing string.

An additional object of the present invention is the provision of production apparatus and method for producing a slanted borehole having a wellhead arranged at an angle respective to the horizontal, wherein the apparatus includes a fluid conveying rotatable mandrel for an anchor device having slips that can be set from the surface of the ground in response to movement of the tubing string.

Another object of the present invention is the provision of a rotatable production tubing string having an upper end thereof suspended from a slanted wellhead and placed in tension by releasably anchoring the lower marginal end of the production tubing string to the interior of a well casing, and additionally providing a downhole journal means in the anchor device, and a tubing rotator apparatus at the surface of the ground; and the further provision of means by which the downhole journal means can be locked and unlocked by manipulating the upper end of the tubing string from the surface of the ground so that the tubing string and other production equipment can be removed from the wellbore.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein for use with the disclosed method.

DETAILED DESCRIPTION OF THE PREFERRED EMBODIMENT

Throughout the various Figures of the drawings, wherever it is possible and logical to do so, like or similar numerals refer to like or similar elements.

Figure 1:
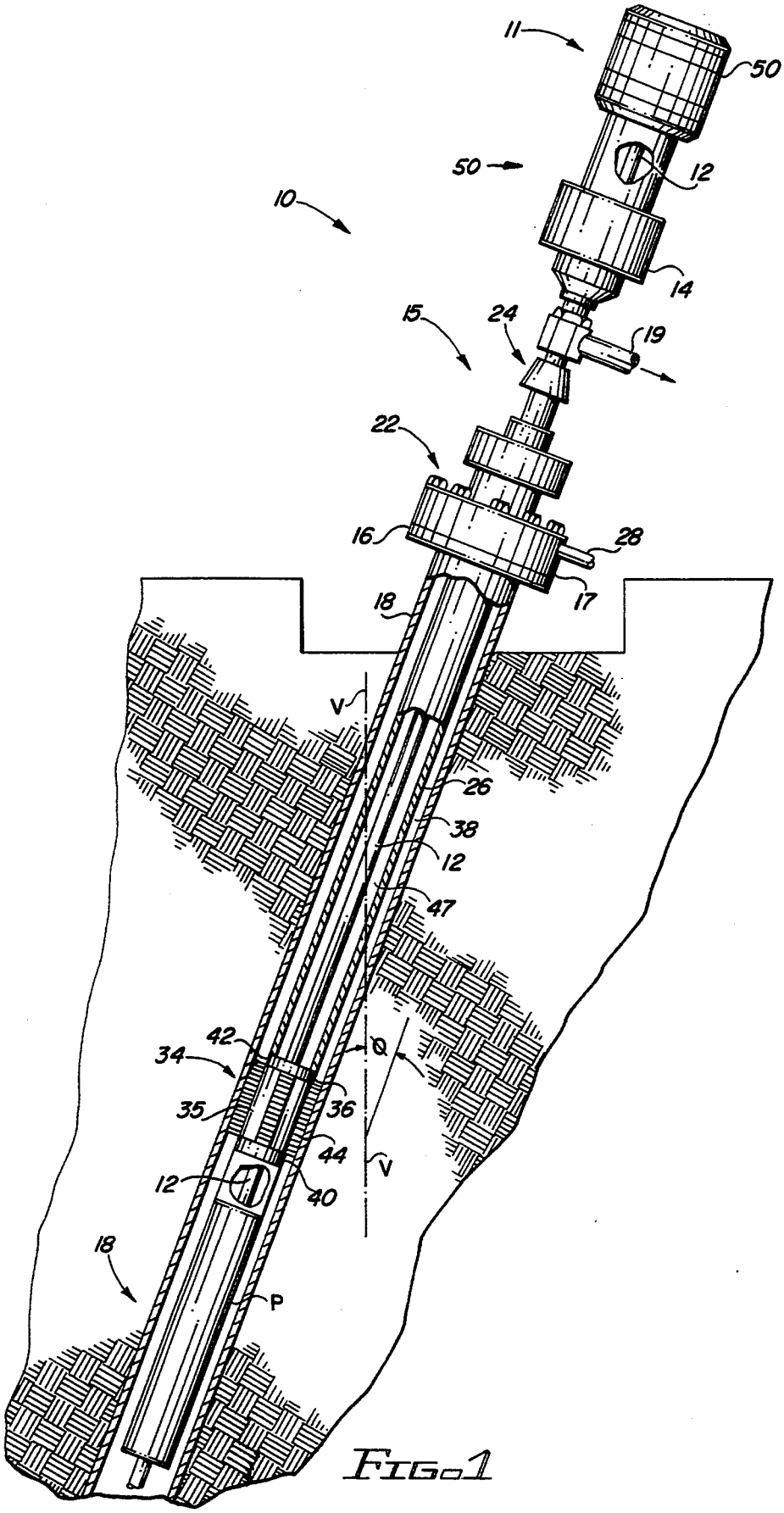
FIG. 1 is a part diagrammatical, part schematical, broken, part cross-sectional side view of apparatus made in accordance with the present invention.

FIG. 1 of the drawings diagrammatically discloses a production unit 10, made in accordance with this invention, by which the illustrated wellbore is produced. A shaft 12, which can be a rotational power output shaft or a reciprocating polish rod, sealingly extends through a seal means 14 which can be a stuffing box located above the wellhead 16, for example. Produced fluid pumped from formation 18 flows away from the wellbore through the lateral discharge of christmas tree 15. The wellhead 16 forms the upper terminal end of the borehole casing string 20.

A tubing rotator 22, the details of which are more fully disclosed later on herein and still more fully in our prior patent, is fastened to the wellhead 16 by adaptor 17. Produced fluid flowing through the rotator 22 is connected to discharge into a fluid conveying swivel means 24 located below seal means 14. The tubing string 26 is subjected to tension and conveys fluid through the rotator 22 while concurrently rotating respective to the wellhead 16, casing 20, and seal means 14.

Actuator shaft means 28 is attached to operate the tubing rotator 22 and thereby rotates a hanger mandrel 35 (see key way 30, 32 and 33 of FIGS. 4 and 5) connected to the upper end of the tubing string 26 which supports the tubing string from the wellhead 16. Thus, the tubing string 26 is placed in tension while it is concurrently rotated by the hanger mandrel 33. The details of the hanger mandrel 33 and the tubing rotator 22 are more fully set forth in our prior patent.

An improved, novel, downhole anchor device 34, sometime referred to as an anchor tubing catcher, and made in accordance with the present invention, has a fluid conveying rotatable anchor mandrel 35 (see FIGS.

1–4) extending from opposed ends thereof. Upper end 36 (FIGS. 1, 2 and 4) of the anchor mandrel 35 is connected to production tubing string 26 and forms part of the tubing string. The tubing string 26 forms annulus 38 respective to the casing 20. A lower end 40 of the mandrel 35 is affixed to the upper end of the lower part 42 of the tubing string. The anchor device 34 includes slip assembly 44 having individual slips mounted for radial movement respective to a barrel 46 (FIG. 4) and radially extends from the central longitudinal axis of the anchor device 34 for engagement with the interior wall surface of casing 20. The anchor mandrel 35 has a lower end 40 thereof attached to an upper end of a lower length 42 of production tubing string 26 within which a downhole pump P resides. Other downhole tools, such as gas anchors, seating nipples, and the like, may be included below the anchor device 34, as may be desired. These other downhole tools are known to those skilled in the art.

Figure 2:
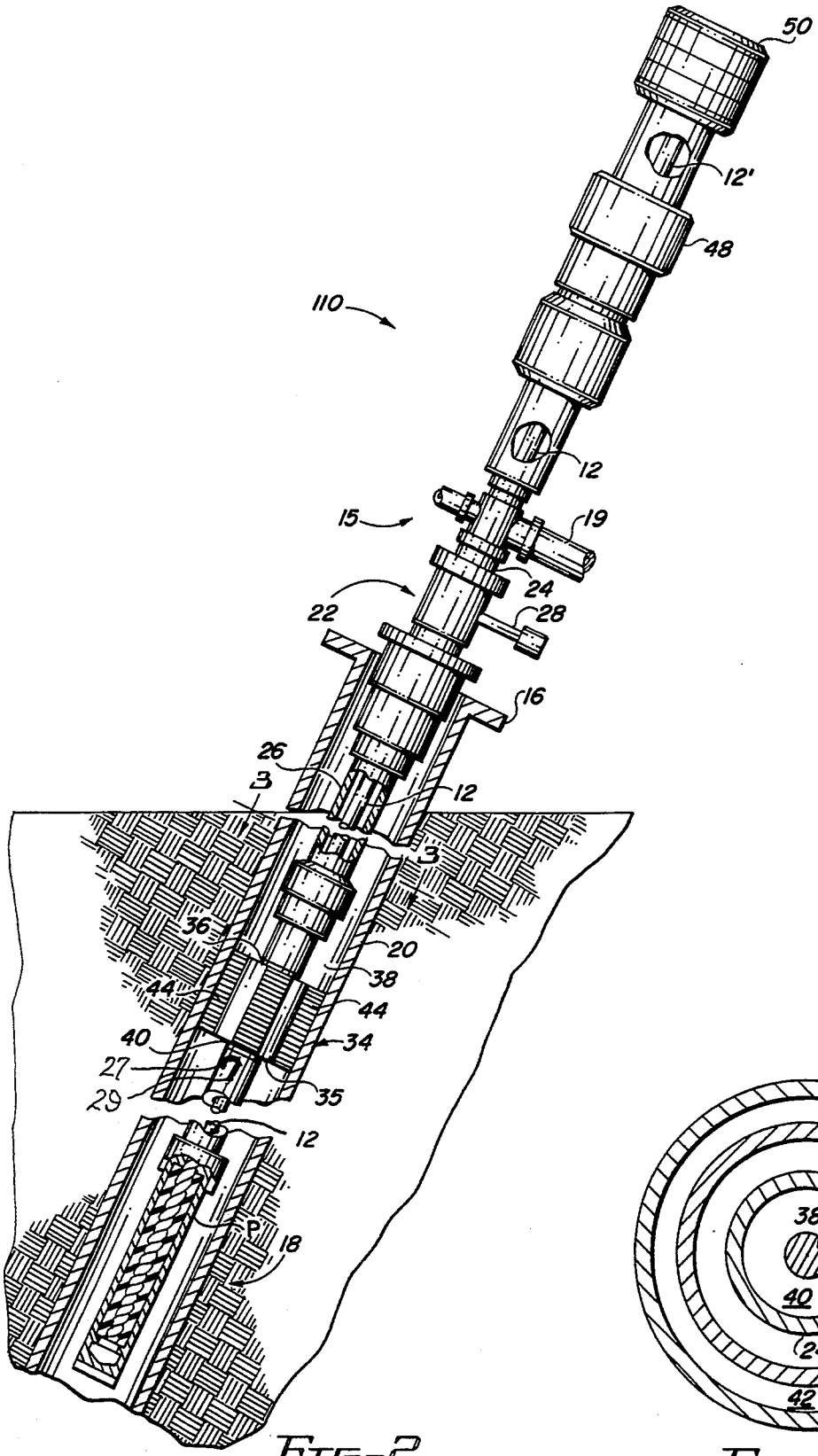
FIG. 2 is a fragmentary, part diagrammatical, part schematical, part cross-sectional side view of a more specific embodiment of the apparatus of FIG. 1 and made in accordance with the present invention.
Figure 3:
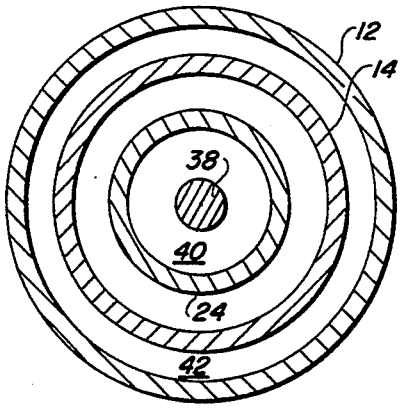
FIG. 3 is an enlarged cross-sectional view of the oil well production unit of FIG. 2 taken along line 3—3 thereof.

FIGS. 2 and 3 of the drawings, wherein like or similar numerals refer to like or similar elements, more specifically disclose a production unit 110 by which a wellbore is produced. As seen illustrated in FIG. 2, a crooked wellbore having a rod actuated downhole pump P by which fluid is produced up a tubing string 26 to the surface S of the ground and to a slanted wellhead 16 at the top of the wellbore. An anchor device 34, by which the lower end of the tubing string 26 is anchored to the lower end of the wellbore, places the tubing string 26 in tension to provide method and apparatus by which wear between a sucker rod string and the, interior wall of a tubing string 26 is reduced.

A tubing rotator means 22 is supported from the slanted wellhead 16 and transfers the load presented by the tubing string 26 into the wellhead 16 by connecting the upper end of the slanted tubing string 26 to the tubing rotator means 22. The tubing rotator means 22 includes a hanger mandrel 33 (see FIGS. 4 and 5) which is rotatably mounted in the tubing rotator 22.

The downhole tubing anchor device 34 of FIG. 2 connects the lower end of the tubing string 26 to said anchor mandrel 35 and thereby places a downhole force on the downhole end of the tubing string 26 which results in the tubing string being placed in tension. This provides a new combination, as well as a new method of producing a crooked borehole that terminates in a slanted wellhead.

In FIG. 2, J-latch 27 cooperated with J-pin 29 to latch and unlatch the slip assembly 44 in the retracted and extended configuration to thereby allow the anchor device 34 to be run into and out of the borehole.

Still looking at FIGS. 2 and 3, a gear box 48 is driven by a motor 50 which can be electric or hydraulic actuated, and preferably hydraulic. A hydraulic pump (not shown) can be connected to provide a suitable supply of power fluid to the motor 50.

The pump P is rotated by the rod or shaft 12 which is rotated by the gear box 48. The motor is connected to drive the gear box by means of the rotating power shaft 12'. Formation fluid flows from the pay zone or formation 18, into the casing 20, where the fluid is produced by the rotating pump P. The produced fluid flows up the tubing annulus to the wellhead, through the hanger mandrel 33 of the tubing rotator 22, through the swivel means 24, and is discharged at 19 from Christmas tree 15.

Figure 4:
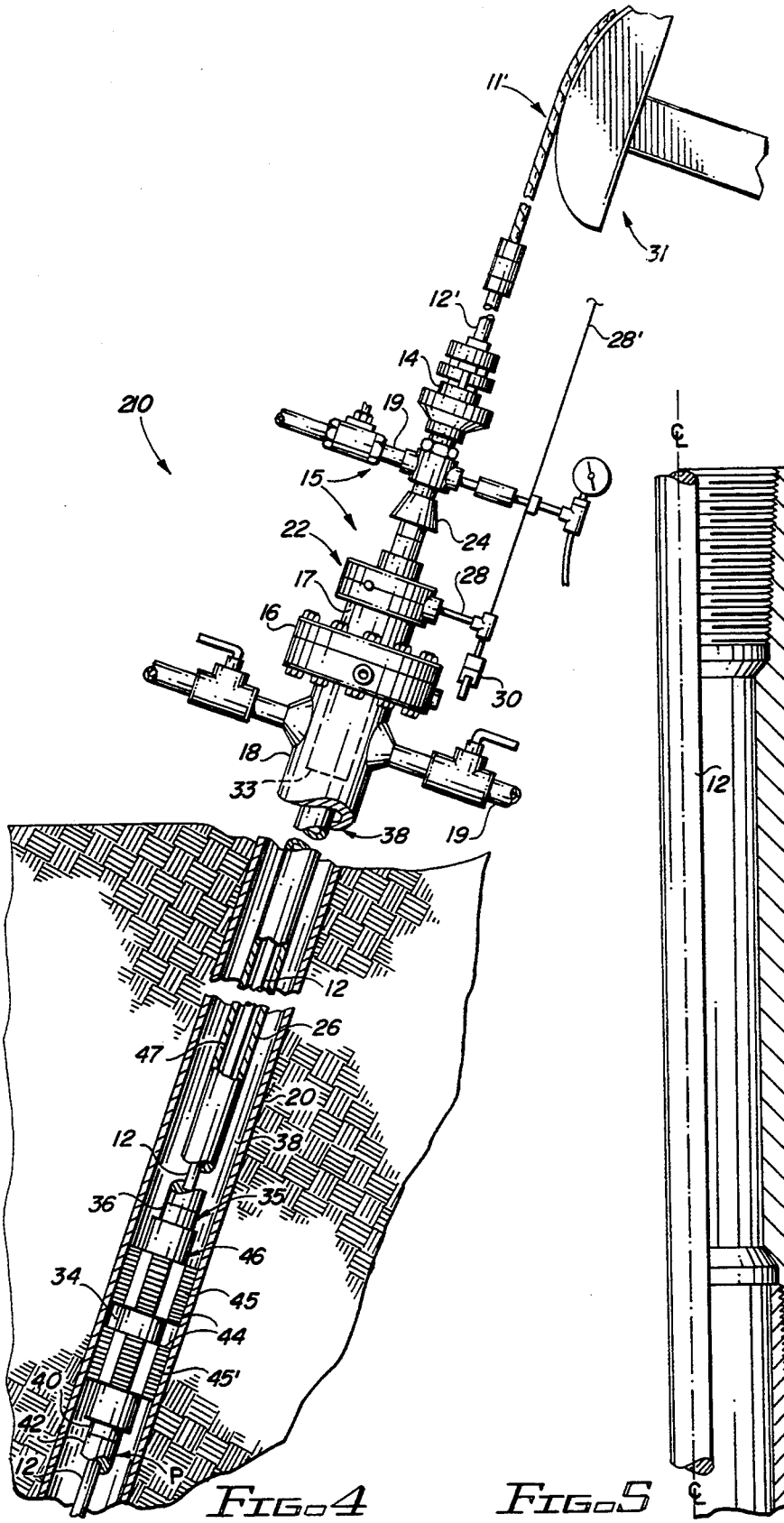
FIG. 4 is a broken, side elevational, part cross-sectional view of an oil well production unit that is similar to FIG. 2, and having apparatus made in accordance with the present invention included therein, with some parts thereof being broken away therefrom, and some of the remaining parts being shown in cross-section; and, FIG. 5 is an enlarged, part cross-sectional view that illustrate details of various parts of the apparatus disclosed in the foregoing Figures of the drawings.

FIG. 4 of the drawings discloses more specific details of an embodiment of this invention in combination with a pumpjack unit by which a wellbore is produced. A production unit 210, made in accordance with this invention, includes a pumpjack unit 31 having a horse head 31 and bridle 11' for reciprocating a polish rod 12' is shown. The polish rod 12' sealingly extends through a stuffing box 14 located on the Christmas tree 15 and into a wellhead 16 attached to the upper end of the usual casing 20, that is located below the surface and extends downhole to form a cased borehole. Produced fluid flows away from the wellbore through lateral pipe 19, that forms a discharge.

A tubing rotator 22, the details of which are more fully disclosed later on herein and in my co-pending patent application, is fastened to the wellhead 16 by adaptor 17 and is connected to a fluid conveying swivel means 24 at a location interposed between stuffing box 14 and tubing rotator 22 so that the tensioned tubing string 26 can convey fluid therethrough while rotating respective to the wellhead 16, casing 20, and stuffing box 14. Actuator pull line 28' is attached to the free end of a ratchet arm 30 and is successively pulled by each oscillation of the rocking beam at 31 (only partially shown) and thereby successively ratchets and thereby rotates a shaft 28 by oscillating the ratchet arm 30 in response to each oscillation of the horse-head and walking beam of the pumpjack unit 11. The tubing rotator 22 is connected to rotate a hanger mandrel 33 (see FIGS. 4 and 5) by which the upper end of the tubing string 26 is supported from the wellhead 16 and can be placed in tension while it is concurrently rotated by the hanger mandrel 33. The details of the hanger mandrel 33 and the tubing rotator 22 is more fully set forth in FIG. 5 and in our prior patent.

A downhole anchor device 34, sometime referred to as an anchor tubing catcher, and made in accordance with the present invention, has a fluid conveying rotatable anchor mandrel 35 (see FIG. 4 extending from opposed ends thereof. Upper end 36 of the anchor mandrel 35 is connected to the lower end of production tubing string 26 and forms part of the tubing string. The tubing string 26 forms casing annulus 38 respective to the casing 20. The anchor device 34 includes a slip assembly 44 having individual slips 45 mounted for radial movement respective to a barrel 46 thereof and radially extend from the central longitudinal axis of the anchor device 34 for engagement with the interior wall surface of casing 20. The lower end 40 of the anchor mandrel 35 of the anchor device 34 is attached to an upper end of a lower length 42 of production tubing string 26 within which a downhole pump P (not completely shown) resides. Other downhole tools, such as gas anchors, seating nipples, and the like, may be included below the anchor device 34, as may be desired. These other downhole tools are known to those skilled in the art.

FIGS. 4, together with other figures of the drawings, illustrate the rod string 12 extending through the rotatable, tensioned production tubing string 26 and thereby forming an irregular annulus 47 therewith due to the rod, tubing and casing being located in a crooked, slanted borehole. The mandrel 35 of FIGS. 1–4 has an interior diameter that is approximately equal to the inside diameter of the tubing string 26 so that anything that can be lowered down through the production tubing string can also be extended through the anchor device of the present invention. This avoids costly fishing jobs.

The details of the relationship between the various parts of the anchor device 34 is particularly disclosed in our prior patent which shows a locking device having a J-pin captured within a J-slot of the mandrel and barrel thereof. The J-pin and barrel is positioned to lock the mandrel and barrel together to prevent relative axial rotation therebetween. This locked position allows the slips of the slip assembly 44 to be positioned in a neutral or retracted position so that the anchor device can be run downhole wit,hour, becoming engaged with the casing sidewall. The J-pin is moved into the groove when the anchor slips are set and the mandrel rotated respective to the barrel and casing.

In this position, the locking action of the J-latch device has rendered the mandrel substantially immovable respective to the barrel, and the mandrel cannot be manipulated for setting the un-set slips of the anchor device until the J-pin is manipulated by the mandrel out of the slot and into the operative position.

The unit 110 of FIG. 2 is a modification of a commercially available Moyno downhole pump system, having added thereto the before discussed anchor device 34 installed near the lower end of the tool string, and a tubing rotator 22 installed near the top of the tool string. This provides a new combination, as well as a method of producing a crooked borehole that terminates in a slanted wellhead.

Figure 5:
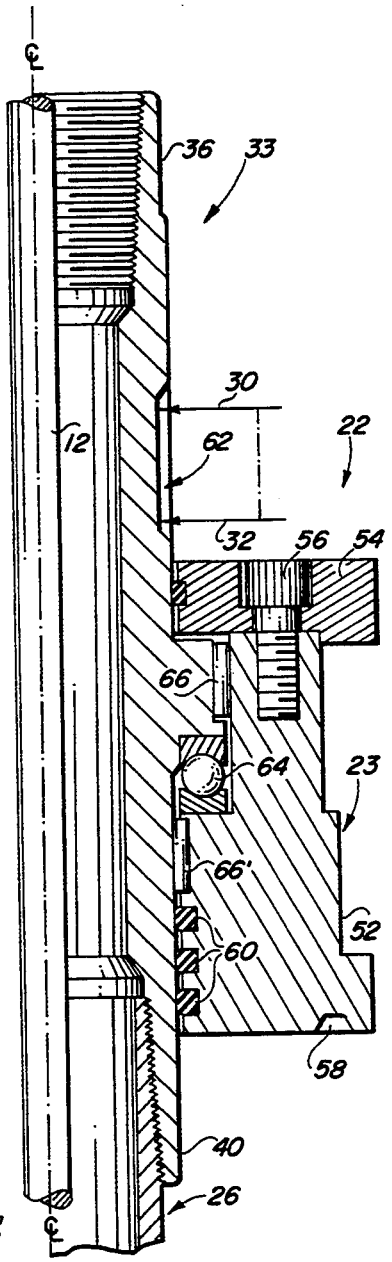

FIG. 5 discloses the details of the tubing rotator 22. The rotator 22 has a main housing 52 concentrically arranged about hanger mandrel 33 and is provided with removable cap member 54 attached thereto by means of bolt circle 56. Housing 52 has a lower face 58 that is seated on wellhead 16. Seal means 60 ride against a lower marginal end of the mandrel 33. A key-way 62 is engaged by a gearbox or the like as schematically indicated by numerals 30, 32, for rotating the mandrel 33 respective to housing 52. Between the housing and the mandrel there is formed a bearing chamber within which are mounted spaced bearings 64, 66 for low friction engagement between the mandrel and housing.

In operation, the tubing anchor device 34 is interposed within the tubing string any desired distance above pump P, the locking device is placed in the locked position, and the apparatus is run downhole into the borehole on the tubing string to a predetermined depth, thereby properly spacing out the pump and associated apparatus. At, this time the upper end of the tubing string is manipulated to extend and set slip assembly 44 of the anchor device 34 into engagement with the casing wall.

Then the wellhead 16, along with the tubing rotator 22 and other illustrated members, are all assembled, the tubing string is set down, causing mandrel 35 to urge the J-pin into the unlocked rotatable configuration; whereupon the tubing is then picked up, using a weight indicator, to assure that the tubing lower end is rotatably anchored to the casing.

The rotator 22 is connected in the manner of FIGS. 1 and 4 so that oscillation of the rocking beam of a pumpjack unit 31 moves the actuator pull line 28' each upstroke of the polish rod and thereby pulls the line which oscillates ratchet arm 30 which in turn successively rotates shaft 28 to thereby rotate the drive mechanism therefor and to rotate the hanger mandrel 33 which in turn rotates tubing string 26 all the way from upper swivel means 24 down to the lower end of the anchor mandrel.

It is possible to successfully use this invention in a crooked slanted hole with the anchor set at 7,000 feet, for example, the tail pipe extending 6300 feet therebelow, and the seating nipple located at 12,290 feet for a total depth of 13,300 feet.

In a slanted borehole having a crooked upper marginal length of 5,000 feet, for example, from the bottom of which there extends a horizontal marginal length of 1200 feet, for example, it is possible to successfully use this invention with the anchor being set at the bottom of the vertical 5,000 foot length of the borehole and the tail pipe extending therebelow and into the horizontal 1200 foot marginal length thereof, whereby the anchor mandrel rotates the tail pipe located in the horizontal section of the borehole.

I claim:

1. In a system having a cased slanted wellbore and a slanted wellhead, a production unit that includes a rod actuated downhole pump connected to produce fluid up through a tubing string to the surface of the ground, the tubing string having an upper end and a lower end, the combination with said production unit of apparatus by which the tubing string is rotated while the tubing string is held in tension;

said apparatus includes an upper tubing rotator means connected to rotatably support the upper end of the tubing string from the wellhead; a downhole tubing anchor device connected to the tubing string at a location downhole in the borehole by which a lower end of the tubing string is rotatably anchored to the cased wellbore;

said downhole tubing anchor device has a hollow mandrel that is connected to form part of the tubing string; said anchor device includes extensible slip means mounted to move radially respective to the mandrel;

said mandrel is concentrically arranged about the rod; slip setting means selectively extending said slip means into engagement with the cased wellbore and thereby releasably attach the lower end of the tubing string to the cased wellbore; said slip setting means are associated with said mandrel for moving said slip means radially outward into engagement with the cased wellbore in response to upward movement of the mandrel; and thereafter the mandrel is rotated by the tubing string while the lower end of the tubing string is held in place by the anchor device;

whereby, the rotating tubing string is placed in tension between said upper tubing rotator means and said anchor device.

2. The combination of claim 1 wherein said tubing rotator means includes a hanger mandrel for supporting and rotating the upper end of the tubing string, means connected to rotate the hanger mandrel, and means by which the upper end of the tubing string is removably attached to the hanger mandrel; said slanted wellhead forms an angle that is within a range of 7–45 degrees respective to a vertical plane, and a motor connected to actuate the rod and thereby actuate the downhole pump.

3. The improvement of claim 1 wherein said anchor device includes a barrel concentrically arranged respectively to the anchor mandrel; locking means connected to selectively lock said mandrel to said barrel in response to manipulation of the tubing string; means by which said tubing string, when the mandrel is locked to the barrel, can be actuated to set and release the slip means of the anchor device respective to the cased wellbore;

and means connected to rotate the rod which in turn rotates the downhole pump.

4. In a system having a cased slanted wellbore and a slanted wellhead, a production unit that includes a rod actuated downhole pump connected to produce fluid up through a tubing string to the surface of the ground, the tubing string having an upper end and a lower end, the combination with said production unit of apparatus by which the tubing string is rotated while the tubing string is held in tension;

said apparatus includes a tubing rotator means connected to rotatably support the upper end of the tubing string from the wellhead; a downhole tubing anchor device connected to the tubing string at a location downhole in the borehole by which a lower end of the tubing string is rotatably anchored to the cased wellbore;

said downhole tubing anchor device has a hollow mandrel that is connected to form part of the tubing string; said anchor device includes extensible slip means mounted to move radially respective to the mandrel;

said mandrel is concentrically arranged about the rod; means selectively extending said slip means into engagement with the cased wellbore and thereby releasably attach the lower end of the tubing string to the cased wellbore; whereby, the rotating tubing string is placed in tension between said upper tubing rotator and said anchor device;

means connecting a motor to actuate the rod which in turn actuates the downhole pump; said mandrel has an enlargement thereon that forms a shoulder, and bearing means abuttingly received against the mandrel shoulder for supporting said mandrel from the cased wellbore to hold the tubing string in tension and to set the slip means.

5. In a crooked, cased, wellbore that is slanted and has a rod actuated downhole pump for producing fluid up a tubing string to the surface of the ground, a slanted wellhead at the top of the casing, the improvement comprising; a tubing rotator means by which an upper end of the tubing string is rotatably supported from the wellhead; an anchor device connected to anchor a lower end of the tubing string to the cased wellbore and thereby place the tubing string in tension between the rotator means and the anchor device;

said rotator means includes a hollow hanger mandrel rotatably supporting the upper end of the tubing string from the wellhead; swivel means connected to the hanger mandrel at a location above the hanger mandrel through which produced fluid from the tubing string can flow;

said anchor device has a hollow mandrel extending therethrough for flow of fluid produced by the downhole pump, said anchor device is positioned downhole in the wellbore;

the hollow anchor mandrel circumferentially extends about said rod; journal means rotatably mounting the hollow anchor mandrel respective to the anchor device, and slip means mounted to move radially respective to the anchor mandrel to releasably fix the anchor device to the interior of the cased wellbore; and means extending said slip means into engagement with the interior of the cased wellbore;

whereby, the hanger mandrel transfers the load of the tubing into the wellhead and thereby places the upper end of the tubing string in tension while the anchor device transfers the tension load of the tubing string into the cased wellbore wail and thereby places the lower end of the tubing string in tension, with there being a passageway that extends through said swivel, hanger mandrel, tubing string, and anchor mandrel, through which the rod extends for actuating the downhole pump.

6. The improvement of claim 5 wherein locking means are connected to selectively lock said anchor mandrel respective to the slip means in response to manipulation of the tubing string; means by which said tubing string, when the anchor mandrel is locked, can be actuated to set and release the slip means of the anchor device respective to the cased wellbore; said wellhead is slanted at an angle in the range of 7–45 degrees respective to a vertical plane; and a motor for actuating the rod which in turn actuates a downhole pump.

7. The improvement of claim 5 wherein said anchor includes a barrel forming a housing about said anchor mandrel and to which said anchor mandrel is rotatably journaled; the locking means is located on the mandrel and barrel and includes a J-slot which terminates in a circumferentially extending groove and a J-pin enters the J-slot to lock the mandrel respective to the barrel, said J-pin enters the groove to unlock the mandrel respective to the barrel;

the slip means of said anchor device is attached to said barrel and is extended into attached relationship respective to the cased wellbore and is retracted in response to said mandrel being manipulated by the tubing string.

8. The improvement of claim 5 wherein there is a pumpjack unit connected to reciprocate the rod which in turn reciprocates the downhole pump; said tubing rotator means includes apparatus for rotating the hanger mandrel in response to reciprocation of the pumpjack unit; said wellhead is slanted at an angle within a range of 7–45 degrees respective to the vertical.

9. In a crooked wellbore having a rod actuated downhole pump by which fluid is produced up a tubing string to the surface of the ground, a slanted wellhead at the top of a wellbore, an anchor device by which the lower end of the tubing string is anchored to a lower end of the wellbore to place the tubing string in tension; the method of reducing wear between the rod string and the interior wall of the tubing string; comprising the steps of:

supporting a tubing rotator means from the slanted well head;

transferring the load presented by the tubing string into the wellhead by connecting the upper end of the tubing string to said tubing rotator means;

rotatably mounting an anchor mandrel within the downhole anchor device and connecting the lower end of the tubing string to said mandrel; and, placing a downhole force on the downhole end of the tubing string by urging said anchor device in a downhole direction and thereafter setting the anchor device within the lower end of the wellbore to thereby place the tubing string in tension.

10. The method of claim 9 and further including the steps of:

locking the mandrel respective to the anchor device and thereafter manipulating the tubing string to retract said anchor device from attached relationship respective to the wellbore wall;

unlocking the mandrel respective to the anchor device and thereafter rotating the tubing string from the surface while conveying fluid through the rotating production tubing; and further including the steps of reciprocating the rod with a pump jack unit in order to actuate the downhole pump.

11. The method of claim 10 and further including the steps of fixing and releasing the anchor device downhole in the borehole by means of slips that are moved radially outward into engagement with the interior surface of the wellbore when the mandrel is lifted up hole by the tubing string.

12. The method of claim 9 and further including the steps of reciprocating the rod with a pumpjack unit in order to actuate the downhole pump; selectively locking said anchor mandrel respective to said anchor device in response to manipulation of the tubing string to thereby set and release the slip means of the anchor device respective to the borehole wall.

13. The method of claim 9 and further including the steps of actuating the downhole pump by reciprocating the rod with a pumpjack unit; flowing produced fluid from the downhole pump and through the tubing string and through a swivel joint located above the tubing rotator and below a stuffing box associated with a pumpjack unit;

using the hanger to place the upper end of the tubing string in tension while the anchor means places the lower end of the tubing string in tension with the tension load at the hanger being greater than the static weight of the tubing; forming a passageway that extends through said swivel, hanger, tubing string, and through the anchor through which the reciprocating sucker rod extends.

14. In a slanted, crooked, cased wellbore that is produced by a shaft actuated downhole pump to lift fluid up through a tubing string to a wellhead at the surface of the ground, the improvement comprising:

a tubing rotator by which the upper end of the tubing string is supported and rotated; a swivel means above the upper end of the tubing string through which produced fluid can flow;

a tubing anchor near the lower end of the tubing string; an anchor mandrel within a barrel, means supporting said anchor mandrel within said barrel, slip means supported on said barrel for radial movement respective to said barrel; bearing means by which said anchor mandrel is rotatably affixed to said barrel; and means connected between said anchor mandrel and barrel to extend said slip means into engagement with the wall of the cased wellbore in response to axial movement of the mandrel respective to the barrel;

whereby, the tubing string can be placed in tension between the rotator and the anchor and the tensioned tubing string rotated respective to the casing.

* * * * *